US008233260B2

(12) United States Patent
Pianezze et al.

(10) Patent No.: US 8,233,260 B2
(45) Date of Patent: Jul. 31, 2012

(54) COMPACT GAS LIGHTING DEVICE FOR AN ELECTRIC HOUSEHOLD APPLIANCE

(75) Inventors: Daniele Pianezze, Cassano Magnago (IT); Massimo Aleardi, Cassano Magnago (IT)

(73) Assignee: ITW Industrial Components S.R.L. Con Unico Socio, Milan (IT)

( * ) Notice: Subject to any disclaimer, the term of this patent is extended or adjusted under 35 U.S.C. 154(b) by 303 days.

(21) Appl. No.: 12/529,329

(22) PCT Filed: Mar. 25, 2008

(86) PCT No.: PCT/IB2008/000702
§ 371 (c)(1),
(2), (4) Date: Aug. 31, 2009

(87) PCT Pub. No.: WO2008/117163
PCT Pub. Date: Oct. 2, 2008

(65) Prior Publication Data

US 2010/0033892 A1 Feb. 11, 2010

(30) Foreign Application Priority Data

Mar. 26, 2007 (IT) ..... TO2007A0215

(51) Int. Cl.
*F23Q 3/00* (2006.01)

(52) U.S. Cl. ..... 361/263

(58) Field of Classification Search ..... 361/263, 361/247, 253, 261; 431/258
See application file for complete search history.

(56) References Cited

U.S. PATENT DOCUMENTS

| | | | | |
|---|---|---|---|---|
| 4,677,960 | A | 7/1987 | Ward | |
| 6,059,479 | A | 5/2000 | Clune | |
| 6,429,606 | B1 * | 8/2002 | Aleardi et al. | 315/363 |
| 7,097,447 | B2 | 8/2006 | Pianezze | |
| 2005/0052819 | A1 * | 3/2005 | Pianezze | 361/263 |

FOREIGN PATENT DOCUMENTS

| | | | |
|---|---|---|---|
| DE | 9415187 | U1 | 11/1994 |
| EP | 0930464 | A2 | 7/1999 |

(Continued)

OTHER PUBLICATIONS

ISR for PCT/IB2008/000702 filed Oct. 1, 2008.

(Continued)

*Primary Examiner* — Rexford Barnie
*Assistant Examiner* — Christopher Clark
(74) *Attorney, Agent, or Firm* — Lowe Hauptman Ham & Berner LLP

(57) ABSTRACT

A gas lighting device including: a body formed by an electrically insulating material and carrying a plurality of high-voltage outputs for the connection to spark generating means; a transformer accommodated in the body and including a primary winding wound about and carried by a ferromagnetic material core, a carrying element formed by an electrically insulating material and designed to contain within a tubular drum thereof the primary winding, and a secondary winding consisting of a plurality of coils externally carried by the drum of the carrying element, electrically insulated from the primary winding and essentially coaxial with the latter; the core is bar-shaped and accommodated inside the carrying element and the drum directly supports also the high-voltage outputs, which are integrally obtained on the drum so as to form therewith the carrying element and laterally overhangingly protrude from the drum.

9 Claims, 2 Drawing Sheets

FOREIGN PATENT DOCUMENTS

| | | | |
|---|---|---|---|
| EP | 1469255 | A1 | 10/2004 |
| FR | 2834048 | A1 | 6/2003 |
| RU | 2063579 | C1 | 7/1996 |
| SU | 1670294 | A1 | 8/1991 |
| WO | 8604118 | A1 | 7/1986 |
| WO | 0007217 | A2 | 2/2000 |
| WO | 2005093325 | A1 | 10/2005 |

OTHER PUBLICATIONS

Russian Official Decision on Grant for Application No. 2009139235, dated Sep. 29, 2010.

* cited by examiner

COMPACT GAS LIGHTING DEVICE FOR AN ELECTRIC HOUSEHOLD APPLIANCE

The present application is based on International Application Number PCT/IB2008/000702 filed Mar. 25, 2008, and claims priority from Italian Application Number TO2007A000215 filed Mar. 26, 2007, the disclosures of which are hereby incorportated by reference herein in their entirety.

TECHNICAL FIELD

The present invention relates to a gas lighting device of the type intended to equip an electric household appliance, such as for example a cooking range, displaying reduced dimensions, high assembly easiness and cost-effectiveness.

BACKGROUND ART

It is known that the electronic gas lighting devices currently marketed, e.g. of the type described in EP-A-1469255 to the same Applicant, comprise a casing formed by electrically insulating material, in which high-voltage pulse generator means are arranged comprising electronic control means and a transformer provided with a primary winding and a secondary winding, the latter composed of a plurality of coils, carried by at least one element formed by electrically insulating material consisting of a drum in which the primary winding is accommodated, along with a ferrite bar constituting the ferromagnetic core, and outside which the coils constituting the secondary winding are wound.

The known devices, while being entirely satisfactory from a technical point of view, are however relatively large in size, particularly in the axial direction; in particular, the device known from EP-A-1469255 already displays many improvements from this point of view, in addition to brilliantly solving the specific problem of cost-effectively and simply equipping cooking ranges provided with either an even or an odd number of burners, but does not entirely solve the technical problem of obtaining more compactness in length of the device and facilitating the assembly thereof to the maximum.

DISCLOSURE OF INVENTION

It is thus the object of the present invention to improve the known gas lighting devices by providing an electronic gas lighting device displaying reduced size and high assembly easiness and which may be manufactured and assembled with low costs, in particular having a structure so that it can be assembled making an extensive use of pre-mounted parts, possibly by means of simple operations, so as to be performed by automatic machines.

The present invention thus relates to an electronic gas lighting device for an electric household appliance, in particular for a cooking range, as defined in claim 1.

In particular, the gas lighting device made according to the invention comprises: a body (3) formed by an electrically insulating material and carrying a plurality of high-voltage outputs for the connection to spark generating means of the cooking range; and a transformer accommodated in the body and in turn comprising a primary winding wound about and carried by a ferromagnetic material core, a carrying element formed by an electrically insulating material and designed to contain the primary winding therein, and a secondary winding consisting of a plurality of coils externally carried by the carrying element, electrically insulated from the primary winding and essentially coaxial with the latter.

According to a first aspect of the invention, the carrying element comprises a drum arranged coaxial to the windings and supporting the same and the high-voltage outputs, the latter comprising corresponding electric terminals and corresponding electric terminal supports, integrally obtained in one piece with the drum, laterally overhangingly protruding from the same.

Furthermore, the body is cup-shaped so as to define an internal concavity provided with a mouth through which the carrying element with the primary and secondary windings and the core pre-mounted thereon may be accommodated in the concavity; the concavity being filled in use with an electrically insulating resin, in which the carrying element, the windings and the core are embedded, with the high-voltage outputs integrally obtained with the electric terminal supports and protrudingly surfacing from the resin.

In this manner, it is possible to obtain at the same time a high assembly easiness of the windings, assembly which may be performed automatically and with subsequent preassembly of the entire transformer before the final assembly on the body of the gas lighting device, without altering the current layout of the gas lighting device as a whole and of the existing assembly systems.

Furthermore, the size of the gas lighting device is greatly reduced as a whole, especially in length, in virtue of the rational design of the entire structure of the gas lighting device.

Further advantages are then ensured by the fact that, in virtue of the described structure, the high-voltage outputs may be arranged at the mouth, so as to overhangingly protrude in use out from the resin, and by the fact that the electric terminal supports may be obtained at opposite ends of the drum, on both sides of the same, thus allowing to connect the opposite ends of each coil belonging to the second winding directly to the corresponding electric terminals of the high-voltage outputs.

BRIEF DESCRIPTION OF THE DRAWINGS

Further features and advantages of the invention will be apparent from the following description of a non-limitative embodiment thereof, with reference to the figures in the accompanying drawings, wherein.

BEST MODE FOR CARRYING OUT THE INVENTION

Figure 1:
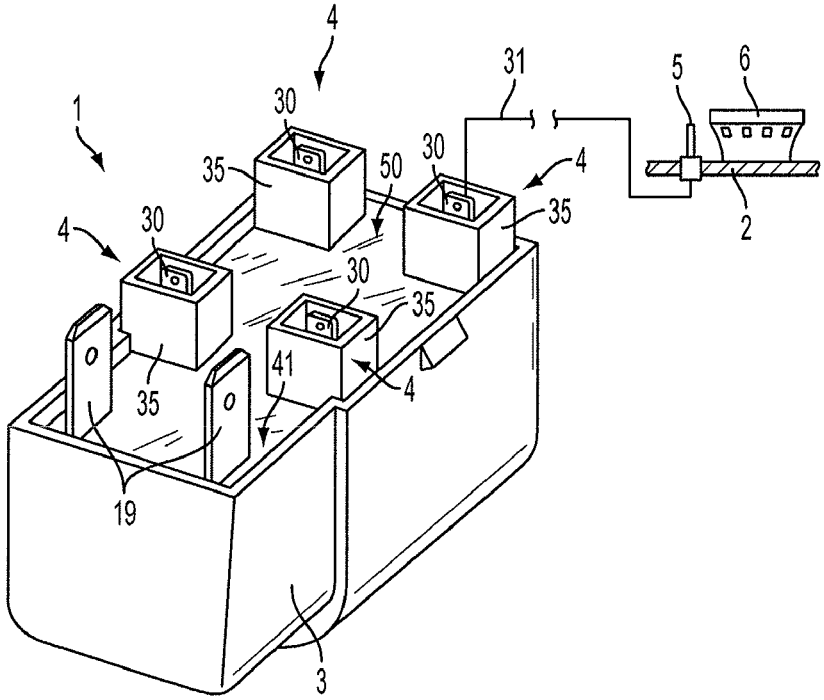
FIG. 1 shows a front three-quarter perspective view of an electronic gas lighting device made according to the invention.
Figure 2:
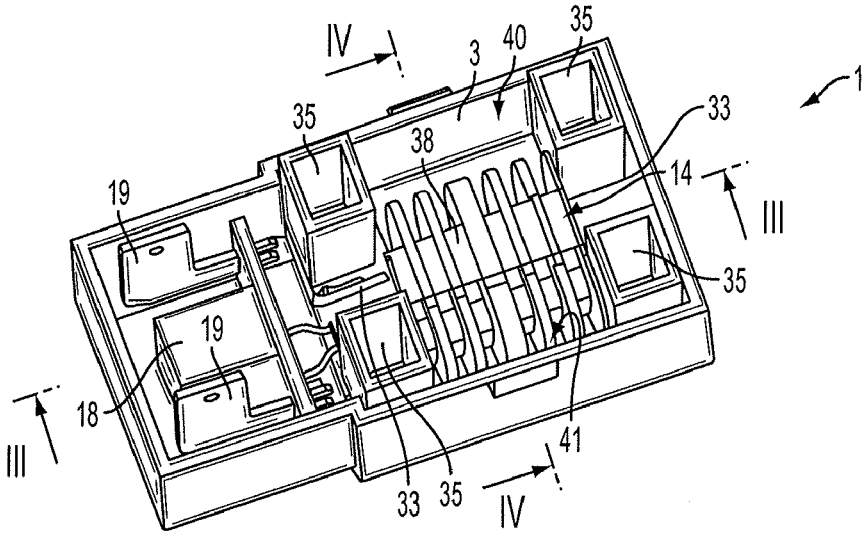
FIG. 2 shows a top three-quarter view with parts removed for clarity of the gas lighting device in FIG. 1.

With reference to figures from 1 to 4, numeral 1 indicates as a whole a gas lighting device for an electric household appliance, which is, in the non-limiting embodiment show, a cooking range 2 (FIGS. 1, 3 and 4); the device 1 comprises a body 3 formed by an electrically insulating material, e.g. a synthetic plastic material such as polyamide, and carrying a plurality of high-voltage outputs 4 for the connection to spark generating means 5 of the cooking range 2; in the shown embodiment, the means 5 are spark plug electrodes integrally mounted to the cooking range 2 in a known manner and each close to a burner or stove 6 (FIG. 1) of any known type adapted to equip the cooking range 2 and the body 3 is provided with known, e.g. snapping, fastening means 7 (FIG. 4) to the cooking range 2, against which it may be mounted in use, in a known manner (FIG. 4) at one or more fastening holes 8 adapted to accommodate the fastening means 7.

The gas lighting device 1 further comprises a transformer 10 (FIG. 3) accommodated in the body 3 and in turn comprising a primary winding 11 wound about and carried by a core 12 formed by ferromagnetic material (e.g. ferrite), a carrying element 14 formed by an electrically insulating material, e.g. the same synthetic plastic material as the body 3, and designed to internally contain the primary winding 11, and a secondary winding 15 (FIGS. 3 and 4) composed of a plurality of coils 16 externally carried by the carrying element 14, electrically insulated from the primary winding 11 and essentially coaxial with the latter.

Figure 3:
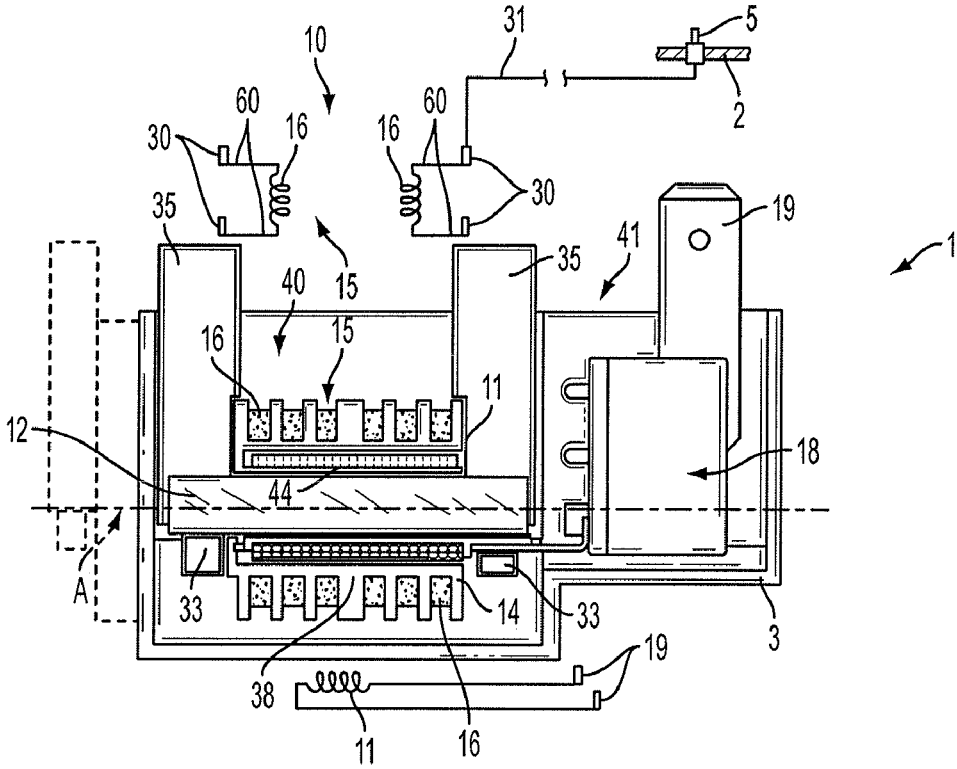
FIGS. 3 and 4 respectively show (FIG. 4 on enlarged scale) corresponding section views taken along plotting planes III-III and IV-IV of the gas lighting device in FIGS. 1 and 2.

The gas lighting device 1 finally comprises known electronic control means 18, also accommodated in the body 3, and a pair of power supply contacts 19, e.g. of the faston-type. In FIG. 3, the windings 11 and 15 are also diagrammatically shown, separated from the rest of the figure, by means of their wiring diagram for better understanding.

Figure 4:
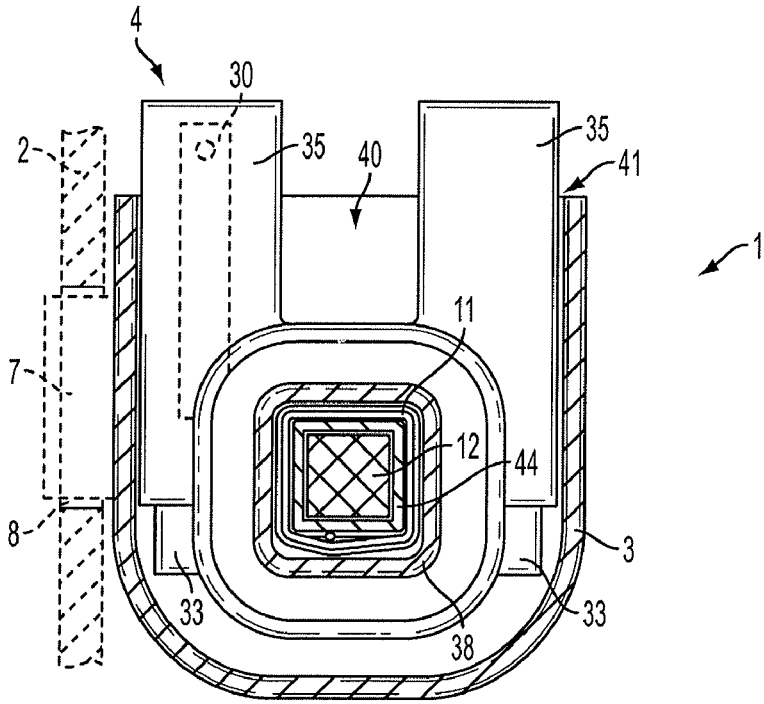

The core 12 is accommodated inside the carrying element 14 (FIGS. 3 and 4) and is thus surrounded in use by the windings 11,15, and displays a prismatic shape (is essentially defined by a parallelepiped bar formed by ferrite or other suitable material) and, preferably, displays a square-shaped cross section (FIG. 4).

According to a first aspect of the invention, the high-voltage outputs 4 are integrally obtained on a drum 38 of the carrying element 14, so as to form, with the drum, part of the carrying element 14 itself and laterally overhangingly protrude from the drum 38.

Specifically, the high-voltage outputs 4 each comprise an electric terminal 30, preferably consisting of a male faston-type strip contact (FIGS. 1 and 4) couplable in use to electric wires 31 for the connection to the electrodes 5 provided with female faston terminals, known and not shown for the sake of simplicity. Alternatively, the terminals 30 may however be made according to the teachings of a co-pending patent application by the same Applicant, in the form of flat terminals, couplable to corresponding flat terminals (not shown) of the electric wires 31 by simple frontal facing.

According to another aspect of the invention, each high-voltage output 4 further comprises an electrically insulating support 33 for the corresponding electric terminal 30 (FIG. 4) and a prismatic tubular element 35 adapted to accommodate the corresponding electric terminal 30 therein, terminal which is integrally carried, preferably in a snapping manner, by the corresponding support 33, arranged immediately underneath the prismatic tubular element 33.

Specifically, the drum 38 belonging to the carrying element 14 is defined by a tubular bushing, in this case with a prismatic-shaped cross section, arranged coaxially with the windings 11 and 15 and supporting the same, the winding 11 therein and the winding 15 on the external side surface thereof; as shown, the supports 33 for the electric terminals 30 are integrally obtained in one piece with the drum 38, so as to form an integral part of the carrying element 14 therewith and laterally overhangingly protrude from the drum 38.

Moreover, according to a further aspect of the invention, the body 3 is cup-shaped so as to define an internal concavity 40 provided with a mouth 41 through which the body 3 may receive in the concavity 40 the carrying element 14, with the primary winding 11 and the secondary winding 15 and with the core 12 already pre-mounted on the same; for this purpose, the winding 11 is also preferably mounted and wound on a tubular carrying element 44 thereof (FIGS. 3 and 4) coaxial with the drum 38, which is inserted into the drum 38 after having been pre-mounted thereon the winding 11 and in which the prismatic bar formed by ferrite constituting the core 12 is then inserted.

The concavity 40 is designed to be filled in use with a known electrically insulating resin 50 (FIG. 1), in which, according to the invention, not only the core 12 with the carrying elements 14 and 44 and the windings 11 and 15 (which thus remain electrically insulated) are embedded, but also most part of the high-voltage outputs 4, which protrudingly surface from the resin 50.

Indeed, according to a last aspect of the invention, also the prismatic tubular element 35 of each high-voltage output 4 is integrally obtained in one piece with the corresponding support 33 immediately underneath, so as to form an integral part of the carrying element 14 as well; thus, the latter is accommodated within the concavity 40 with the prismatic tubular elements 35 (and the corresponding electric terminals 30) facing towards the outside of the concavity 40 and protruding outwards from the same through the mouth 41, so as to overhangingly protrude out from the resin 50, in use, obtaining in this manner a simple and cost-effective positioning of the outputs 4, instead of needing to integrally obtain them with the body 3, as in the known art.

Finally, the electric terminal supports 30 are preferably obtained at opposite ends of the drum 38, on both sides of the same, so as to obtain a symmetric arrangement with respect to the core 12 and to a symmetry axis A of the core 12 and of the windings 11 and 15. In combination with this feature, it is thus possible to directly connect the two opposite ends 60 (FIG. 3, diagrammatic part) of each coil 16 belonging to the second winding 15 with respective electric terminals 30 of the high-voltage outputs 4 adjacent to a same end of each corresponding coil 16, while the opposite ends of the winding 11 are connected to the electric terminals 19, by making the electric wire forming the winding 11 run in the direction of the axis A between the winding 11 itself and the support 44 thereof (FIG. 4).

An extremely simple electric connection of the coils 16 to the terminals 4 is thus obtained, which allows to avoid internal passages of the electric wire in the concavity 40 and, above all, the need to cut the electric wire while performing the coiling operation of the winding 15.

Furthermore, in the (rare) case that more than four high-voltage outputs 4 are required (because the cooking range 2 to be equipped has more than four burners) it will be sufficient to elongate the drum 38 (and the body 3 intended to contain it), as shown by the dashed line in FIG. 3, operating in this case the winding of the additional coil(s) in the same way as described in EP-A-1469255, thus being able to preserve the possibility of automatically pre-mounting the windings 11,15 on the corresponding supports 14,44 and, at the same time, maintaining the process advantage at least on the coils 16 arranged between the four adjacent high-voltage outputs 4 closest to the contacts 19.

The invention claimed is:

1. A gas lighting device, comprising:

a body formed by an electrically insulating material and carrying a plurality of high-voltage outputs for connection to spark generating units;

a transformer accommodated in the body and including a ferromagnetic material core, a primary winding wound about and carried by the ferromagnetic material core, a carrying element formed by an electrically insulating material and containing the primary winding therein, and a secondary winding including a plurality of coils externally carried by the carrying element, electrically insulated from and coaxial with the primary winding, the core being accommodated within the carrying element and surrounded by said windings;

wherein said carrying element comprises a drum arranged coaxial to said windings and supporting the windings and said high-voltage outputs;

the high-voltage outputs which are integrally formed with said drum and laterally overhangingly protrude from the drum;

said high-voltage outputs each includes an electric terminal, and an electrically insulating support for the electric terminal, the electrically insulating support being integrally formed in one piece with the drum; and the electrically insulating supports for the electric terminals are formed at opposite ends of said drum, on both sides of each of said ends.

2. The gas lighting device according to claim 1, wherein said body formed by electrically insulating material is cup-shaped so as to define an internal concavity provided with a mouth through which the body receives in said concavity said carrying element with said primary and secondary windings and said core pre-mounted thereon;

said concavity being filled with an electrically insulating resin, in which said carrying element, said windings and said core are embedded, with said high-voltage outputs protrudingly surfacing from the resin.

3. The gas lighting device according to claim 2, wherein said high-voltage outputs each further comprise:

a prismatic tubular element that accommodates said electric terminal therein.

4. The gas lighting device according to claim 3, wherein each said electric terminal comprises a faston-type strip contact integrally carried by the corresponding support.

5. The gas lighting device according to claim 3, wherein said prismatic tubular element of each said high-voltage output is integrally formed in one piece with the corresponding support, so as to be an integral part of said carrying element;

the carrying element is accommodated within said concavity with said prismatic tubular elements facing towards the outside of said concavity and protruding outwards from the concavity through said mouth, so as to be overhangingly protruding out from said resin.

6. The gas lighting device according to claim 1, wherein opposite ends of each said coil belonging to the second winding are electrically directly connected to the corresponding electric terminals of the high-voltage outputs that are formed at the same end of the drum as the coil.

7. The gas lighting device according to claim 1, wherein said core has a prismatic shape.

8. The gas lighting device according to claim 3, wherein each said electric terminal consists of a faston-type strip contact snapped into the corresponding support.

9. The gas lighting device according to claim 1, wherein said core has a square-shaped cross section.

* * * * *